US010717105B1

(12) United States Patent
Barraco

(10) Patent No.: US 10,717,105 B1
(45) Date of Patent: Jul. 21, 2020

(54) MASKING STRIP FOR USE IN PAINTING VEHICLES

(71) Applicant: TNS Solutions, Deer Park, NY (US)

(72) Inventor: Anthony M. Barraco, Islip, NY (US)

(73) Assignee: TNS SOLUTIONS, Deer Park, NY (US)

( * ) Notice: Subject to any disclaimer, the term of this patent is extended or adjusted under 35 U.S.C. 154(b) by 0 days.

(21) Appl. No.: 16/574,711

(22) Filed: Sep. 18, 2019

Related U.S. Application Data

(60) Provisional application No. 62/887,317, filed on Aug. 15, 2019.

(51) Int. Cl.
*B05C 21/00* (2006.01)
*B05D 1/32* (2006.01)

(52) U.S. Cl.
CPC ..... *B05C 21/005* (2013.01); *B05D 1/32* (2013.01)

(58) Field of Classification Search
None
See application file for complete search history.

(56) References Cited

U.S. PATENT DOCUMENTS 5,885,395 A 3/1999 Western
6,627,259 B1 * 9/2003 Jevons ..... B05B 12/26 427/282
2002/0160115 A1 10/2002 Gouret
2005/0011839 A1 1/2005 Dart et al.

FOREIGN PATENT DOCUMENTS

EP 0365510 A1 4/1990
GB 2223425 A 4/1990
WO 9015668 A1 12/1990

* cited by examiner

*Primary Examiner* — Michael P. Rodriguez
(74) *Attorney, Agent, or Firm* — Carter, DeLuca & Farrell LLP

(57) ABSTRACT

A masking strip for use in painting automobile doors includes an elongated flexible body configured to cover a gasket of a door assembly, and an elongated spine extending perpendicularly from the elongated flexible body. The elongated spine is configured for receipt in a narrow opening defined between the door assembly and a front fender.

13 Claims, 5 Drawing Sheets

MASKING STRIP FOR USE IN PAINTING VEHICLES

CROSS-REFERENCE TO RELATED APPLICATIONS

This patent application claims the benefit of and priority to U.S. Provisional Patent Application No. 62/887,317, filed on Aug. 15, 2019, the entire contents of which being incorporated by reference herein.

TECHNICAL FIELD

The present disclosure generally relates to masking strips, and more particularly to masking strips for covering gaskets of a door assembly of an automobile.

BACKGROUND

Currently, the front doors of most modern day vehicles must be removed from the vehicle before refinishing. This is done to gain access to remove the inner door weatherstrip-gasket that is located on the door shell of most new vehicles. This weatherstrip-gasket is located between the front door edge and the rear edge of the fender. If the front doors are not disassembled to remove the weatherstrip-gasket when refinishing the front doors, the weatherstrip-gaskets may be covered in overspray. Overspray is caused by a mist that is created when refinishing a surface on the vehicle. Tiny particles of paint are light enough to float around in the air, when they land, they slowly start to harden and become overspray. Overspray on a molding or weatherstrip may be a sign of a poor repair and may indicate that the vehicle was not brought back to its pre-accident condition or manufacturer's specifications.

When the front doors are removed, time must be spent to remove the wire-harness which is located inside the door jamb. When disconnecting the wire-harness, sometimes the plugs are easily accessible in the door jamb. Other times the disconnect point can be about a foot into the vehicle and the disconnect point will have to be taken out of the door by removing the door panel. Then the wires will be unfastened from the shell and then passed out of the door for disconnection.

In addition, time is spent to reinstall the front door of the vehicle before refinishing to ensure that the color-blend match is correct. After that the front door must be removed a second time after the refinishing process to reinstall the weatherstrip-gasket. Also, sometimes the weatherstrip-gasket can get damaged when removed or the retainer clips can get damaged causing an extra cost of replacing the retainer clips if they are available. Sometimes the retainer clips cannot be purchased separately; therefore, a new molding or weatherstrip may need to be purchased.

Following that, additional time is spent to reinstall the front door and wire harness once more, after reinstalling the weather-strip gasket on the freshly refinished front door. Care must be taken not to damage the newly refinished front door and front fender when the refinished front door and front fender is taken on and off the vehicle for this repair process.

SUMMARY

In one embodiment, in accordance with the principles of the present disclosure, a masking strip for use in painting automobile doors is provided and includes an elongated flexible body and an elongated spine extending perpendicularly from the elongated flexible body. The elongated flexible body is configured to cover a gasket of a door assembly, and the elongated spine is configured for receipt in a narrow opening adjacent the door assembly to inhibit paint from entering the narrow opening.

In aspects, the elongated spine may extend from a central location of the elongated flexible body.

In aspects, the elongated spine may be fabricated from a flexible material.

In aspects, the elongated flexible body and the elongated spine may be monolithically formed.

In aspects, the elongated body may be flat and generally rectangular and have a pair of wings extending outwardly from opposite lateral sides of the elongated spine.

In aspects, the elongated spine may have a longitudinally-extending edge having a lip configured for grasping.

In aspects, the elongated spine may have a pair of planar opposite lateral side surfaces devoid of protuberances.

In accordance with another aspect of the disclosure, a method of preparing a door assembly of an automobile for an application of paint is provided. The method includes positioning an elongated flexible body of a masking strip behind a door assembly to cover a gasket, and positioning an elongated spine of the masking strip through a narrow opening defined between the door assembly and a front fender of the automobile, such that the elongated spine inhibits paint from passing through the narrow opening.

In aspects, the elongated flexible body may be flat and rectangular and have a pair of wings extending laterally from opposite sides of the elongated spine. One wing of the pair of wings may cover the gasket.

In aspects, positioning the elongated flexible body of the masking strip may include sliding the masking strip along an axis defined by the narrow opening.

In aspects, the elongated spine may have a lower edge that protrudes outwardly from the narrow opening.

As used herein, the terms parallel and perpendicular are understood to include relative configurations that are substantially parallel and substantially perpendicular up to about + or −210 degrees from true parallel and true perpendicular.

BRIEF DESCRIPTION OF THE DRAWINGS

The present disclosure will become more readily apparent from the specific description accompanied by the following drawings, in which.

DETAILED DESCRIPTION

Figure 1:
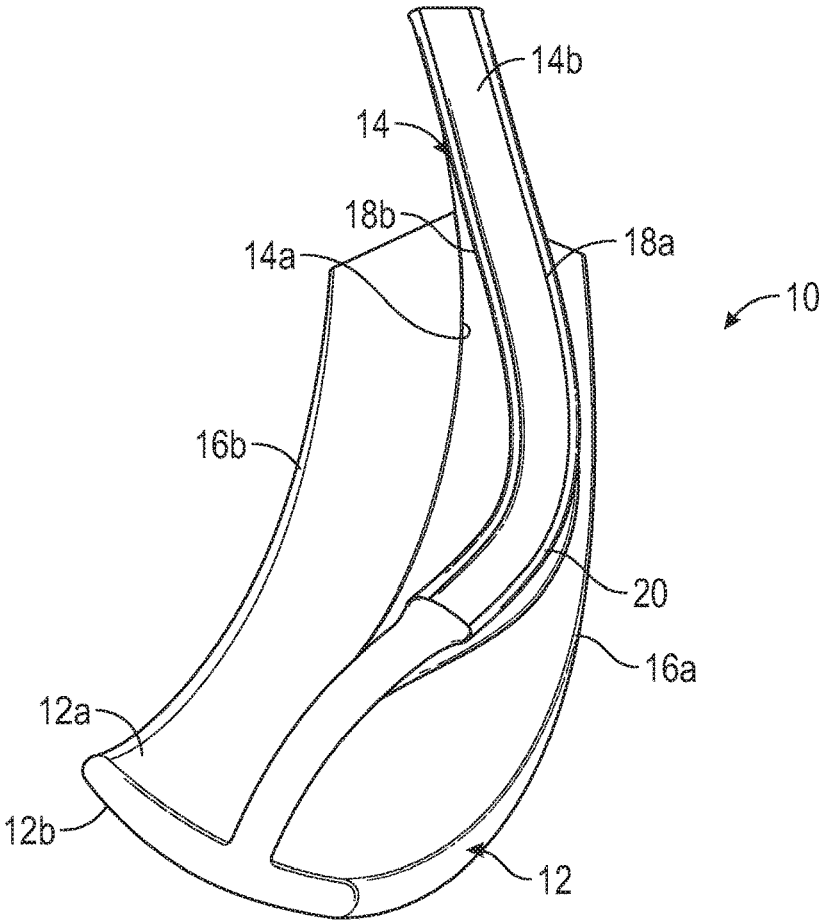
FIG. 1 is a front, perspective view of an exemplary embodiment of a masking strip.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The present disclosure generally provides a flexible strip of material positionable in a crevice defined between a front edge of a front door and a rear edge of a front fender. The presently described masking strip is most applicable when applying paint to door assemblies in vehicles having a gasket located behind the front door assembly and adjacent the front fender. Older vehicles do not have such a gasket, which was added to vehicles to increase the sound barrier, enhance aerodynamics, and/or improve weather-stripping.

The flexible strip of material covers the gasket located behind the front door to prevent overspray from paint from contacting the gasket. This apparatus makes it unnecessary to remove the door from the vehicle to remove and install the weatherstrip-gasket. This apparatus will allow the parts to be painted on the vehicle saving repair time and money.

This apparatus may be fabricated from rubber, or any other suitable flexible material, and used to fill the body opening between the front door and the front fender edge. It is a very quick and effective way to make sure that you do not have any unnecessary over-spray mist blowing or landing onto the front door jambs or weatherstrip-gaskets, which is an area that is difficult to mask with tape. This apparatus will easily conform and seal those body openings that you do not want paint or over-spray to get on.

This apparatus can be applied to the edge of the front door jamb, between the fender and front door when the parts are being prepped for refinishing. The apparatus fits perfectly into the groove between the front door and front fender of the vehicle, and therefore masks off the door jambs and the weatherstrip-gaskets gaps.

This process will protect the front door jambs and weatherstrip-gaskets from any unnecessary overspray during refinishing. Subsequently there will be no need to remove the front doors from the vehicle for refinishing. That is, the apparatus removes the need for clip replacement or weatherstrip replacement. Plus, the apparatus prevents damage to the front doors or front fenders because they no longer have to be removed, reinstalled for refinishing, removal again for the weatherstrip-gasket and harness reinstallation, and then the final process of reinstalling and realigning the front doors for the final time.

The apparatus may be slid along a clean edge/groove of the front door panel, which is located by the back of front fender to make sure that the apparatus fits perfectly leaving no space for overspray to mist onto the weatherstrip-gasket. The apparatus will fill the gap between the front door and fender to protect the gasket and inhibit overspray from contacting the weatherstrip-gasket. The apparatus will allow the vehicle to have clean lines after refinishing with no overspray on the weatherstrip. After using the apparatus, no residue is left behind, unlike when masking tape is used. The apparatus can easily be removed after refinishing by gently starting at the top or bottom of the apparatus and slowly sliding it away from the front doors or fender edge onto which it is attached. This apparatus saves time and the possible risk of damaging the refinished parts from removing and reinstalling the front doors several times.

The apparatus is highly conformable to fit in the needed space between the front doors and the front fender gap, it can resist the high temperatures of drying cycles in the spray booth, and it leaves no residue behind when removed.

Figure 2:
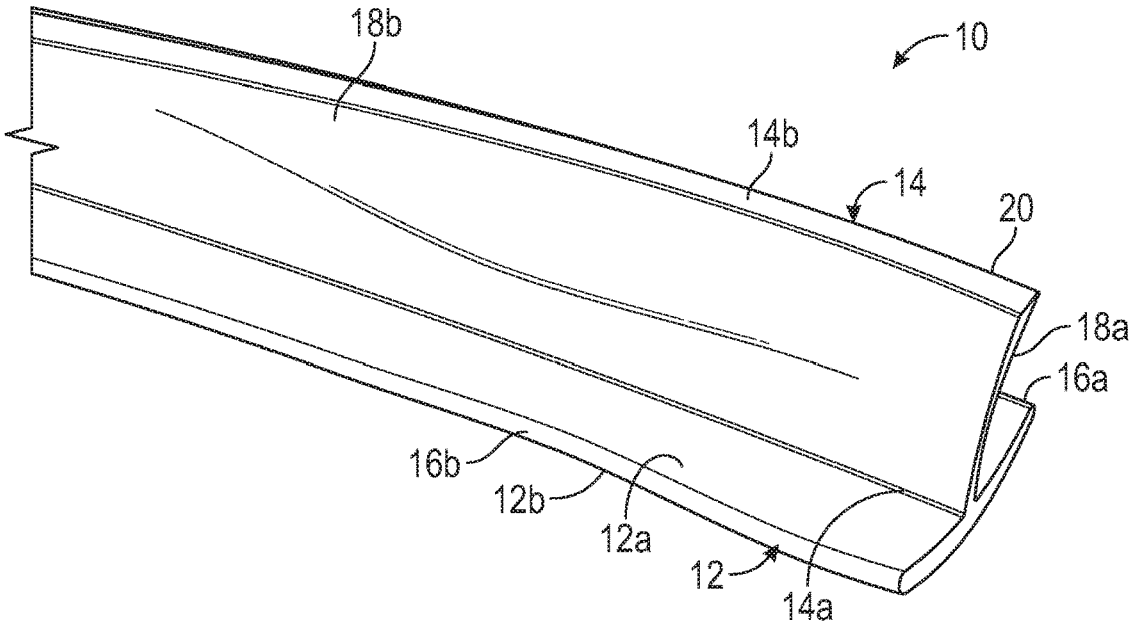
FIG. 2 is a side perspective view illustrating the masking strip of FIG. 1.

With reference to FIGS. 1 and 2, an exemplary embodiment of a masking strip 10 for covering an internal gasket 102 (FIG. 3) of a door assembly 104 is illustrated. The masking strip 10 generally includes an elongated flexible body 12 configured to cover the gasket 102 of the door assembly 104, and an elongated spine 14 extending perpendicularly from the elongated flexible body 12. The elongated flexible body 12 and the elongated spine 14 may be monolithically formed with one another or otherwise attached to one another. The elongated flexible body 12 and the elongated spine 14 may be fabricated from the same material or a different material, such as, for example, silicon, rubber, or the like, to assist a user in inserting and removing the masking strip 10 from a narrow opening or slot 106 (FIG. 3), as will be described. In other aspects, the masking strip 10 may be fabricated from a hard material, such as, for example, metal, a hard plastic (e.g., PVC), or any other suitable material.

The elongated body 12 may be flat or plate-like and/or have a generally rectangular shape. The elongated body 12 may have a concave lower surface 12*a* and a convex upper surface 12*b*. The concave lower surface 12*a* is configured to cover the gasket/weatherstrip 102 of the door assembly 104. The elongated body 12 has a pair of wings 16*a*, 16*b* extending outwardly from opposite lateral sides 18*a*, 18*b* of the elongated spine 14. The first wing 16*a* of the pair of wings 16*a*, 16*b* is configured to cover, overlap, and/or engage the gasket 102 when the masking strip 10 is slid into the door assembly 104. The elongated body 12 has a width that is greater than the narrow opening 106.

The elongated spine 14 of the masking strip 10 is configured for receipt in the narrow opening 106 adjacent the door assembly 104 to inhibit paint from entering the narrow opening 106. As such, the elongated spine 14 has a thickness that is about the same or less than the width of the narrow opening 106. The elongated spine 14 extends from a central location of the elongated flexible body 12, but it is contemplated that the elongated spine 14 may extend from various locations of the elongated flexible body 12. The elongated spine 14 has a longitudinally-extending upper edge 14*a* attached to or formed with the lower surface 12*a* of the elongated body 12, and a longitudinally-extending lower edge 14*b* configured to project outwardly from the opening 106. The lower edge 14*b* may have a lip 20 configured for grasping to facilitate insertion or removal of the masking strip 10. The lip 20 may include rounded edges extending outwardly from the lower edge 14*b*. The elongated spine 14 has a pair of planar opposite lateral side surfaces 18*a*, 18*b* devoid of protuberances so that the spine 12 does not cover the outer edge surface 108 (FIG. 3) of the door assembly 104 or the outer edge surface 110 of the front fender 112. In aspects, the masking strip 10 may be coated with a lubricious material, such as, for example, PTFE.

Figure 3:
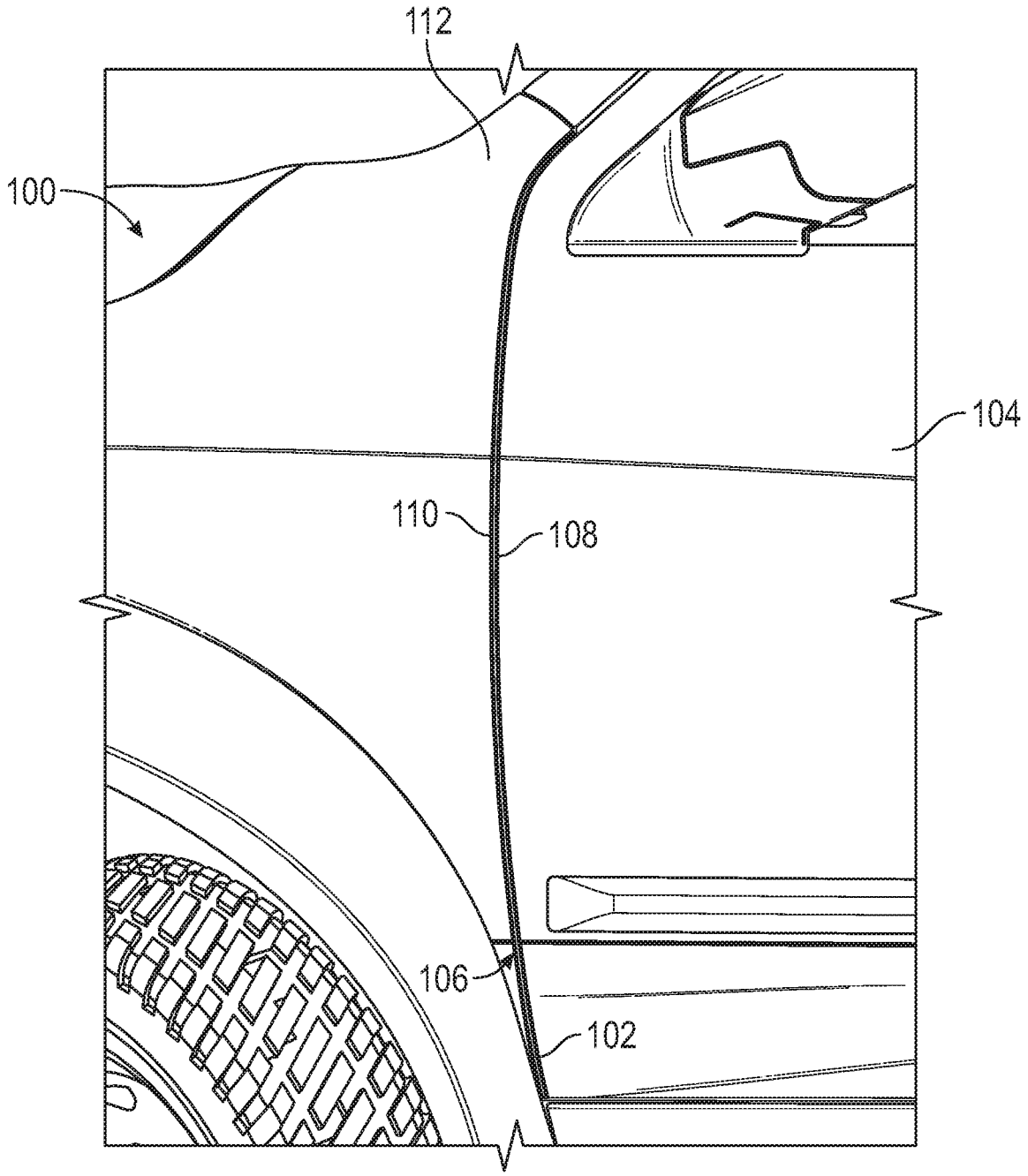
FIG. 3 is a side view illustrating a narrow opening and a gasket disposed between a door assembly of an automobile and a front fender.
Figure 4:
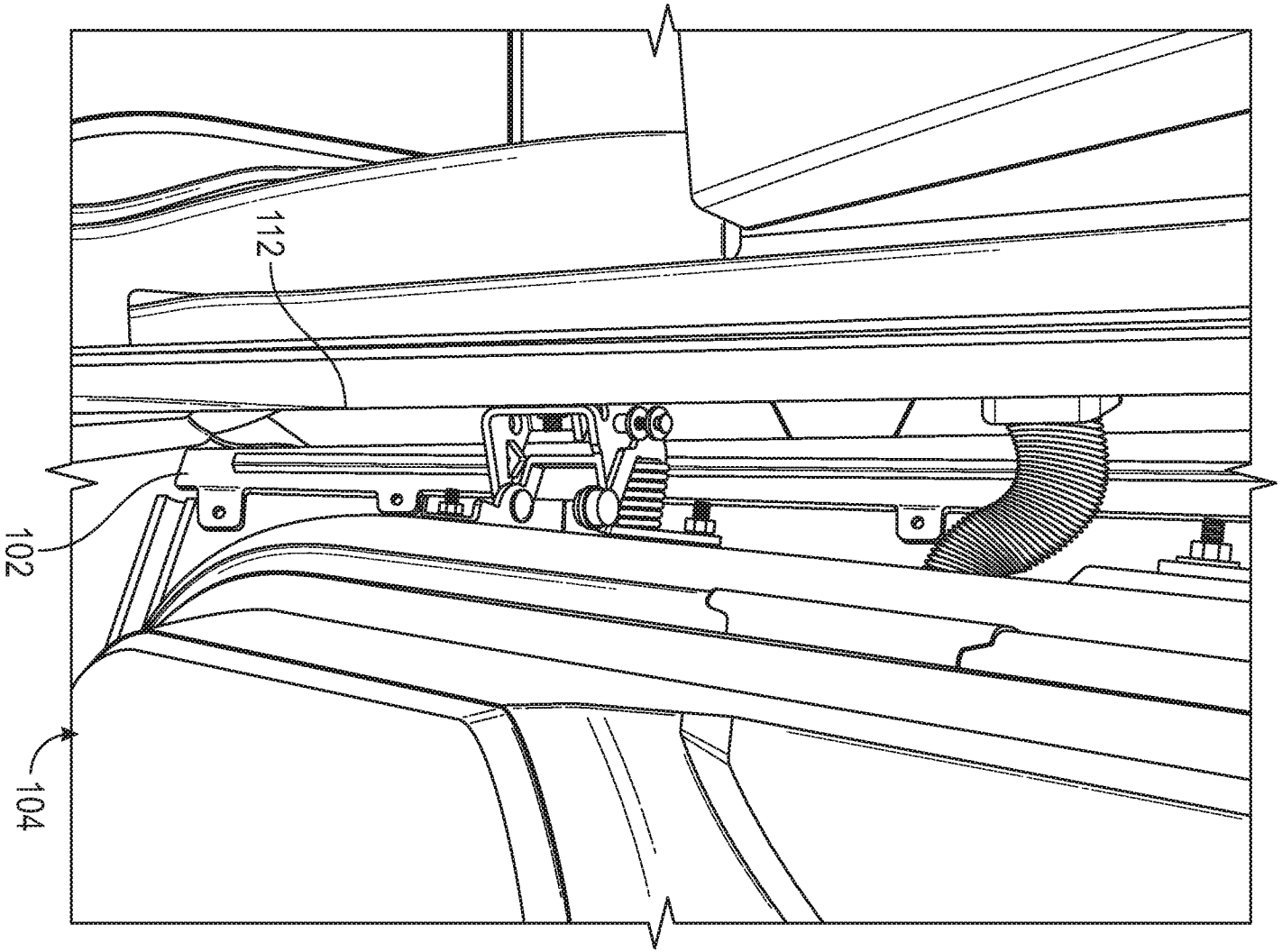
FIG. 4 is a rear view illustrating a connection of the door assembly with the frame of the automobile.

In use, with reference to FIGS. 3 and 4, the masking strip 10 may be utilized to cover the gasket 102 of the door assembly 104 prior to applying paint or some other coating to the door assembly 104 of an automobile 100. The gasket 102 is disposed behind the opening or slot 106 defined between the front edge 108 of the front door 104 and the rear edge 110 of the front fender 112. It is contemplated that the masking strip 10 may be positioned in other openings of the automobile 100. In other aspects, the masking strip 10 may be used to cover various components of other vehicles, such as boats, planes, or the like. In aspects, instead of having a T-shaped transverse cross-section configuration, the masking strip 10 may have an L-shaped transverse cross-section configuration.

Figure 5:
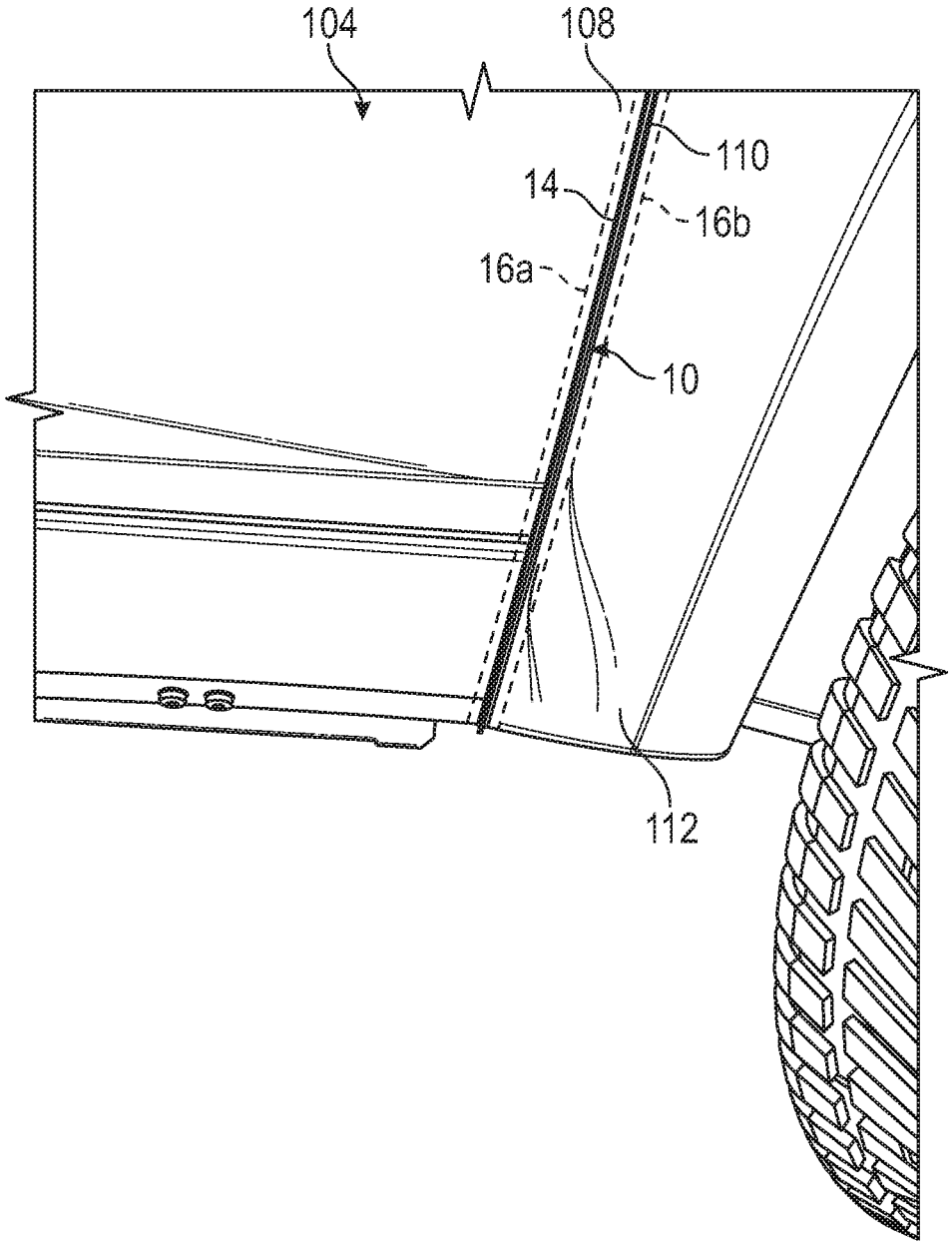
FIG. 5 is a side view illustrating the masking strip of FIG. 1 being positioned into the narrow opening of FIG. 3.
Figure 6:
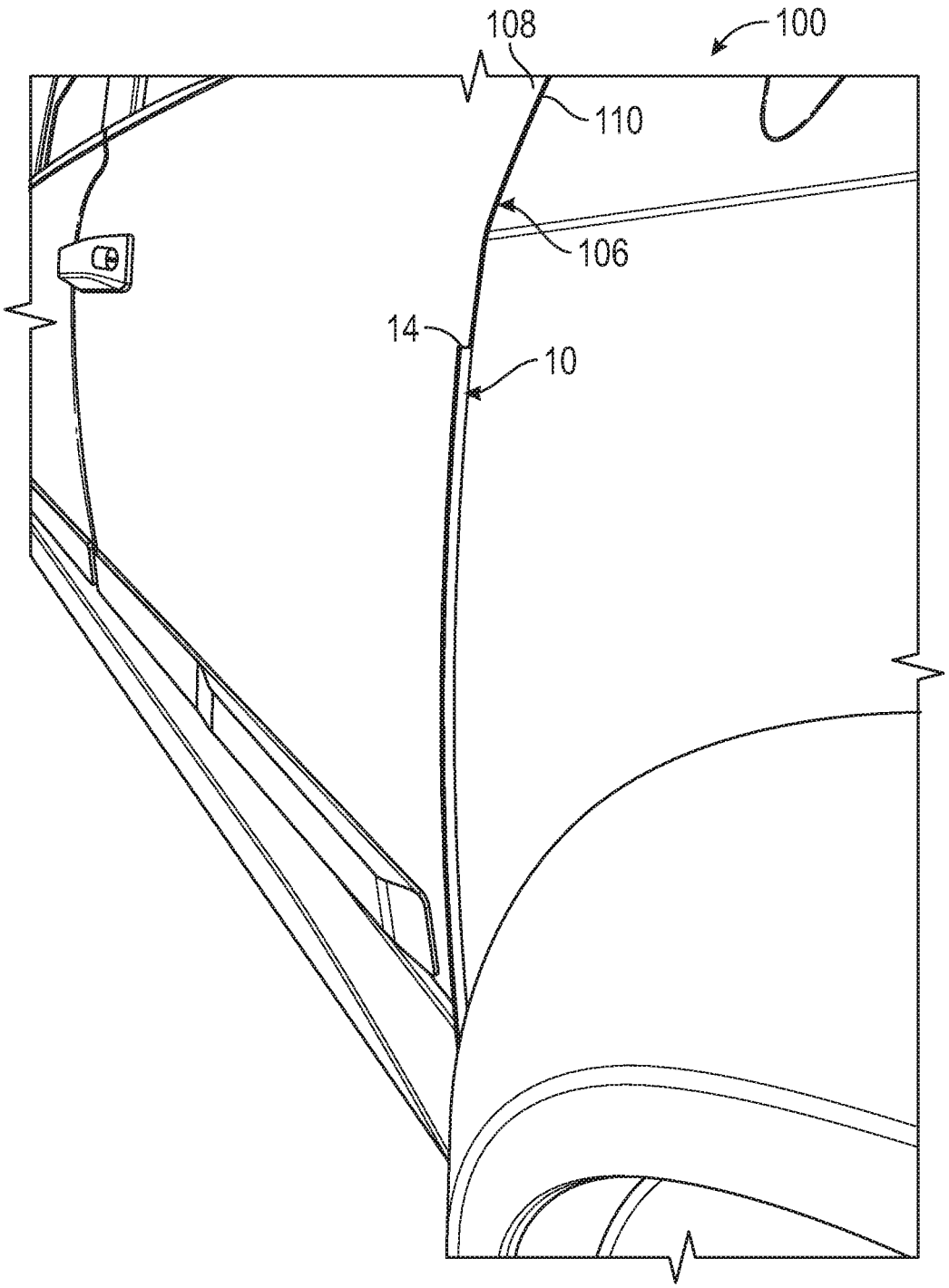
FIG. 6 is a front, perspective view illustrating the masking strip disposed in the narrow opening of FIG. 3.

With reference to FIGS. 5 and 6, an end of the masking strip 10 is slid into a bottom end of the narrow opening 106, with the elongated flexible body 12 of the masking strip 10 positioned behind the door assembly 104, and the elongated spine 14 of the masking strip 10 protruding outwardly through the narrow opening 106 (FIG. 6). In other aspects, the end of the masking strip 10 may be slid into the top end of the narrow opening 106. The masking strip 10 is slid upwardly or downwardly through the opening 106, whereby the wing 16*a* of the elongated flexible body 12 slides over the gasket 102 (FIG. 4), and the elongated spine 14 fills the opening 106. In aspects, instead of sliding the masking strip 10 through the opening 106, the flexible nature of the masking strip 10 may allow a user to press the masking strip 10 into the opening 106. In aspects, the wing 16*a* of the elongated flexible body 12 engages and depresses the gasket 102 upon inserting and sliding the masking strip 10 through the opening 106. Due to the frictional engagement between the elongated flexible body 12 and the gasket 102, the masking strip 10 is held in position to allow a user to paint the door assembly 104. In this way, the wing 16*a* is captured between the front door 104 and the gasket 102, and the wing 16*b* is captured between the front fender 112 and another weatherstrip or gasket (not explicitly shown).

Once the paint has been applied, the masking strip 10 may be removed by sliding the masking strip 10 either upwardly or downwardly. In aspects, to facilitate passage of the masking strip 10 into the opening 106, water, soap water, or some other suitable lubricious fluid may be applied to the masking strip 10 prior to insertion and/or removal.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A method of preparing a door assembly of an automobile for an application of paint, comprising:

positioning a masking strip in a narrow opening defined between a door assembly and a front fender of the automobile; and sliding the masking strip along the narrow opening to cover a gasket with an elongated flexible body of the masking strip, wherein an elongated spine of the masking strip extends through the narrow opening.

2. The method according to claim 1, wherein the elongated flexible body is flat and rectangular and has a pair of wings extending laterally from opposite sides of the elongated spine, at least one wing of the pair of wings covering the gasket.

3. The method according to claim 1, wherein sliding the masking strip includes sliding the masking strip along an axis defined by the narrow opening while the elongated flexible body is disposed behind the door assembly.

4. The method according to claim 1, wherein the elongated spine has a lower edge that protrudes outwardly from the narrow opening.

5. The method according to claim 1, wherein the elongated spine extends along a central longitudinal axis of the elongated flexible body and protrudes outwardly from the narrow opening.

6. The method according to claim 1, wherein the elongated spine is fabricated from a flexible material.

7. The method according to claim 1, wherein the elongated flexible body and the elongated spine are monolithically formed.

8. The method according to claim 1, wherein the elongated spine has a longitudinally-extending edge having a lip configured for grasping.

9. The method according to claim 1, wherein the elongated spine has a pair of planar opposite lateral side surfaces devoid of protuberances.

10. The method according to claim 1, wherein the masking strip is devoid of adhesive.

11. The method according to claim 1, wherein the masking strip frictionally engages the gasket to maintain the masking strip within the narrow opening.

12. The method according to claim 2, wherein a first wing of the pair of wings is positioned behind the door assembly and at a first side of the narrow opening, and a second wing of the pair of wings is positioned behind the front fender at a second side of the narrow opening.

13. The method according to claim 1, wherein the masking strip is slid along the narrow opening while the door assembly is closed.

* * * * *